US012376693B2

(12) United States Patent
Glynos

(10) Patent No.: US 12,376,693 B2
(45) Date of Patent: Aug. 5, 2025

(54) DOOR HINGE ATTACHABLE TELESCOPIC HANGER

(71) Applicant: Peter Glynos, Warren, NJ (US)

(72) Inventor: Peter Glynos, Warren, NJ (US)

( * ) Notice: Subject to any disclaimer, the term of this patent is extended or adjusted under 35 U.S.C. 154(b) by 0 days.

(21) Appl. No.: 18/445,432

(22) Filed: Aug. 11, 2023

(65) Prior Publication Data

US 2025/0049242 A1 Feb. 13, 2025

(51) Int. Cl.

| | |
|---|---|
| ***A47G 25/06*** | (2006.01) |
| *A47B 45/00* | (2006.01) |
| *A47B 61/00* | (2006.01) |
| *A47K 10/10* | (2006.01) |

(52) U.S. Cl.

CPC ..... *A47G 25/0621* (2013.01); *A47G 25/0685* (2013.01); *A47B 45/00* (2013.01); *A47B 61/003* (2013.01); *A47G 25/06* (2013.01); *A47G 25/0607* (2013.01); *A47K 10/10* (2013.01)

(58) Field of Classification Search

CPC ..... A47G 25/0621; A47G 25/0685; A47G 25/0607; A47G 25/06; A47G 25/0664; A47G 25/02; A47G 25/0692; A47B 61/003; A47B 45/00; A47K 10/04; A47K 10/10; D06F 57/12

See application file for complete search history.

(56) References Cited

U.S. PATENT DOCUMENTS

| | | | | | |
|---|---|---|---|---|---|
| 69,587 | A * | 10/1867 | Putnam | A47G 7/045 | 248/290.1 |
| 223,963 | A * | 1/1880 | Taylor | A47G 7/045 | 211/96 |
| 914,697 | A * | 3/1909 | Bryant | A47G 7/045 | 248/213.1 |
| 1,208,986 | A * | 12/1916 | Krodel | F16M 13/02 | 235/114 |
| 1,751,691 | A * | 3/1930 | Flath | F16M 11/2014 | 248/213.1 |
| 2,509,502 | A * | 5/1950 | Hunt | E05D 11/00 | 248/213.1 |
| 2,539,803 | A * | 1/1951 | Westberg | A47G 25/0685 | 211/96 |
| 2,895,698 | A * | 7/1959 | Palmer | A47G 25/08 | 248/213.1 |
| 2,896,791 | A * | 7/1959 | Raber | A47G 25/0621 | 248/213.1 |

(Continued)

*Primary Examiner* — Devin K Barnett

(74) *Attorney, Agent, or Firm* — Wilkinson Law Office; Clinton H. Wilkinson

(57) ABSTRACT

A door hinge-attachable telescopic hanger with: a) a door hinge attachment member, including an open-ended vertical shaft for attachment to a door hinge; b) an elongated main support member connected to the hinge attachment member, extending outwardly therefrom at a non-parallel angle to said vertical shaft; c) at least one moveable supplemental support member telescopically connected to said elongated main support member for movement extending away from said door hinge attachment member; d) a handle-sheath covering at least half said door hinge attachment member and a portion of said elongated main support member. There is a pin having a pin upper section and a pin lower section, and having a stopping flange between said pin upper section and said pin lower section.

14 Claims, 4 Drawing Sheets

(56) References Cited

U.S. PATENT DOCUMENTS 3,044,630 A * 7/1962 Szabo ..... A47G 25/0621 248/213.1
3,145,849 A * 8/1964 Hanson ..... A47G 25/08 248/213.1
3,151,595 A * 10/1964 Stainbrook ..... E02B 3/24 114/230.25
3,158,132 A * 11/1964 Guthrie ..... G09F 17/00 116/28 R
3,788,489 A * 1/1974 Levinthal ..... A47F 5/04 211/163
3,825,127 A * 7/1974 Morrison ..... E05D 11/00 248/289.11
4,042,232 A * 8/1977 Lile ..... A61G 13/12 5/503.1
D271,437 S * 11/1983 Thiot ..... D32/58
4,721,212 A * 1/1988 Lowe ..... A47G 25/0685 211/119.004
5,117,987 A * 6/1992 Lombardo ..... E05D 11/00 211/105.1
D328,195 S * 7/1992 Kotsuka ..... D6/324
5,372,346 A * 12/1994 Upchurch ..... F16M 11/041 D6/567
5,411,231 A * 5/1995 Buck ..... H01F 7/0252 248/206.5
5,425,462 A * 6/1995 Sciranka ..... A47G 25/0621 248/213.1
5,501,345 A 3/1996 Hilstolsky et al.
5,505,317 A 4/1996 Rulis et al.
6,942,111 B2 9/2005 Harrell
7,908,711 B2 * 3/2011 Johnson ..... A47G 25/06 16/369
8,002,225 B1 * 8/2011 Malone ..... A47B 81/00 248/339
8,308,116 B2 * 11/2012 Daniels ..... A47G 25/0678 211/106.01
8,540,087 B1 * 9/2013 Skaer ..... A47G 25/0685 211/100
9,463,903 B2 * 10/2016 Garrett, Sr. ..... B65D 25/22
9,560,927 B2 * 2/2017 Krumpe ..... A47G 25/0607
D842,083 S * 3/2019 Thompson ..... D8/367
10,465,843 B2 * 11/2019 Mantella ..... F16B 45/008
10,946,233 B1 * 3/2021 Neeley, Jr. ..... A63B 21/1663
D917,266 S * 4/2021 Winnie ..... D8/367
11,013,325 B2 * 5/2021 Meyer ..... A47F 5/0006
D945,866 S * 3/2022 Luo ..... D8/367
D968,938 S * 11/2022 Zhou ..... D8/372
D974,885 S * 1/2023 Zhou ..... D8/367
D985,375 S * 5/2023 Chen ..... D8/367
D986,717 S * 5/2023 Chen ..... D8/367
D988,117 S * 6/2023 Chen ..... D8/367
D1,000,259 S * 10/2023 Chen ..... D8/367
11,971,236 B1 * 4/2024 James ..... F41A 23/00
2007/0272637 A1 * 11/2007 Rigas ..... A47G 25/0685 211/119.004

* cited by examiner

DOOR HINGE ATTACHABLE TELESCOPIC HANGER

BACKGROUND OF INVENTION a. Field of Invention

The present invention is a clothes hanger that has components that make it attachable to a door hinge female receiver in place of a conventional door hinge pin, and that is telescopic (adjustable in length). Such hangers may be used for hanging clothes, in lieu of a closet or in addition thereto, or that have been washed and are in need of being hung to dry, or for other hanging purposes. The present invention hangers are hangable on any receiving holder or bracket or mount into which the hangers may be inserted, but are especially useful and by being hung on their modified pins for insertion into female hinge receivers. Typical door hinges have three components—the door mounted flange, with female pin receivers, the doorframe mounted flange with interleafing female pin receivers, and the hinge pin. The present invention hanger has a special pin that holds the hanger and replaces the conventional hinge pin. And the present inventions are portable in that they may be removed form a door hinge or other receiver to another location and/or a different type of receiver.

b. Description of Related Art

The following patents are representative of the field pertaining to the present invention:

U.S. Pat. No. 7,080,727 B1 describes a system, apparatus and method for the handling, transport and or storage of items of wearing apparel which are hung on hangers. In the system, there is plurality or transport units which travel over a rail system from a first location (e.g. an inbound location) to a second location (e.g. an outbound location). Each transport unit has a carrier section which, in the first operating position of the transfer unit, is generally horizontally aligned, and is suspended from a rail by means of first and second roller support sections at opposite ends of the carrier section. The transport unit has a second operating position where the carrier section is rotated relative to one of the roller support sections to a more vertical orientation where the garment units are closer together in a horizontal direction and more vertically aligned with one another, this being a position in which the garment units can be stored and/or shipped in a more closely packed configuration.

U.S. Pat. No. 6,942,111 B2 describes a trolley that is utilized to transport garments or other articles over a rail system between desired locations. The trolley includes a support member and a plurality of trolley heads each disposed at a corresponding support member end. The trolley heads each include a housing with rollers disposed therein and an arm that connects that trolley head to a corresponding end of the support member. The rollers engage a slick rail system to enable the trolley, with the support member in a generally horizontal orientation, to transverse the rail system and transport garments suspended from the support member. One of the trolley ends includes a pivoting mechanism that enables the support member to pivot or swivel with respect to the trolley arm at the end to place the support member in a generally vertical position.

U.S. Pat. No. 5,505,317 describes a pivoting door hinge held catchall rack including a rod which extends vertically along a plurality of door hinges and which is held by the pins of the door hinges threaded through flanges on either end of the rod and/or through screw-eye type devices which are easily threaded into a slot in back of the rod and therefore can be readily aligned with the tops of the hinges. From the rod are extended, appended, fixed or attached a plurality of catchall, shapes and forms.

U.S. Pat. No. 5,501,345 describes a garment holder assembly supports garments while being disposed in either of two different attitudes. The assembly includes an elongated rigid support structure with a plurality of spaced, interior dividers. A hook extends from one or more dividers to support the garment holder assembly in a horizontal attitude. A link secured to one end of the support structure can be connected to a hook for supporting the assembly in a vertical attitude.

U.S. Pat. No. 5,425,462 describes a hinge pin clothes hanger to furnish a quality product made to last, that replaces the hinge pin of any door hinge with a hinge pin clothes hanger that, when properly installed, does not effect the operation of the door or the hinge into which it is being used. The hinge pin clothes hanger is a non-destructive support on which to hang clothes, towels or anything similar, on any door hinge, in any room in which it would be useful. It is easily installed or removed without any damage to the door or hinge. You simply remove the existing hinge pin and install the hinge pin clothes hanger in its place, or simply remove the hinge pin clothes hanger to restore the hinge to its original condition with the original hinge pin. It's that simple. Furthermore, when in use the hinge pin clothes hanger will provide a substantial means of support which will give the consumer years of reliable service and will blend into the decor of the room into which it is being used.

U.S. Pat. No. 5,117,987 discloses a garment support to be detachably mounted upon a door hinge of the type having intermeshing sleeves held together by a hinge pin. The invention comprises a hinge mounting member and a main body member. The hinge mounting member is substantially flat and elongated in shape containing an angled slot at one end capable of receiving the shaft of a hinge pin, and a centered oblong aperture. The main body member is substantially rectangular in shape containing an L-shaped end and a plurality of supports, whereby garments and other articles may be suspended.

U.S. Pat. No. 4,721,212 describes a modular article support unit consisting of an elongated tubular member adapted to be removably attached to the hinge pins of two hinges of a door by means of adjustable brackets, said elongated tubular member having a plurality of holes along the length thereof for removably attaching several types of support devices, such as coat hooks, towel racks, bulletin boards and mirrors.

U.S. Pat. No. 1,208,986 describes the combination of a hinge, an elongated pin carried thereby, and a hook mounted on said pin and provided with a bracing member engaging the hinge.

Notwithstanding the prior art, the present invention is neither taught nor rendered obvious thereby.

SUMMARY OF INVENTION

The present invention is a door hinge-attachable telescopic hanger with pin, which includes: A. a door hinge-attachable telescopic hanger, comprising: a) a door hinge attachment member, including an open-ended vertical shaft for attachment to a door hinge and a pin; b) an elongated main support member connected to the door hinge attachment member and extending outwardly therefrom at a non-parallel angle to the vertical shaft, the elongated main support member extending away from the door hinge attachment member; c) at least one moveable supplemental support member telescopically connected to the elongated main support member for movement extending away from the door hinge attachment member; d) a handle-sheath covering at least half the door hinge attachment member and a portion of the elongated main support member; and, B. a pin having a pin upper section and a pin lower section, and having a stopping flange between the pin upper section and the pin lower section, wherein the pin lower section is adapted to replace a door hinge pin and the upper section is adapted to receive the door hinge attachment member by inserting the pin upper section into the vertical shaft of the door hinge attachment member.

In some embodiments of the present invention door hinge attachable telescopic hanger, the door hinge attachment member vertical shaft is a cylindrical shaft and is adapted to be positioned above a door hinge and on the upper portion of the pin.

In some embodiments of the present invention door hinge attachable telescopic hanger, the elongated main support member is hollow and the at least one moveable supplemental support member is positioned therein for telescopic movement in and out of the elongated main support member.

In some embodiments of the present invention door hinge attachable telescopic hanger, the at least one of elongated the main support member and the at least one moveable supplemental support member includes a stop flange that prevents separation during telescoping.

In some embodiments of the present invention door hinge attachable telescopic hanger, the hanger further includes at least one clothes hook.

In some embodiments of the present invention door hinge attachable telescopic hanger, the handle-sheath further includes at least one cut out for the at least one clothes hook.

In some embodiments of the present invention door hinge attachable telescopic hanger, the handle-sheath is a two piece handle-sheath and each piece is connected to one another.

In some embodiments of the present invention door hinge attachable telescopic hanger, the handle-sheath is a two piece plastic handle-sheath that is permanently connected to one another.

In some embodiments of the present invention door hinge attachable telescopic hanger, the elongated main member is positioned at a right angle to the support shaft.

In some embodiments of the present invention door hinge attachable telescopic hanger, the elongated support member is positioned at a top angle of less than 90 degrees.

In some embodiments of the present invention door hinge attachable telescopic hanger, there are two moveable supplemental support members telescopically connected to one another.

In some embodiments of the present invention door hinge attachable telescopic hanger, the door hinge attachment member vertical shaft is a cylindrical shaft and is adapted to be positioned above a door hinge and on the upper portion of the pin.

In some embodiments of the present invention door hinge attachable telescopic hanger, the elongated main support member is hollow and the at least one moveable supplemental support member is positioned therein for telescopic movement in and out of the elongated main support member.

In some embodiments of the present invention door hinge attachable telescopic hanger, the at least one of elongated the main support member and the at least one moveable supplemental support member includes a stop flange that prevents separation during telescoping.

In some embodiments of the present invention door hinge attachable telescopic hanger, the hanger further includes at least one clothes hook.

In some embodiments of the present invention door hinge attachable telescopic hanger, the handle-sheath further includes at least one cut out for the at least one clothes hook.

In some embodiments of the present invention door hinge attachable telescopic hanger, the handle-sheath is a two piece handle-sheath and each piece is connected to one another.

In some embodiments of the present invention door hinge attachable telescopic hanger, the handle-sheath is a two piece plastic handle-sheath that is permanently connected to one another.

In some embodiments of the present invention door hinge attachable telescopic hanger, the elongated main member is positioned at a right angle to the support shaft.

In some embodiments of the present invention door hinge attachable telescopic hanger, the pin has an elongated shaft with at least three different thicknesses, and the stop flange has a greater thickness than the upper section and the lower section, and the upper section has a thickness that is greater than the lower section.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
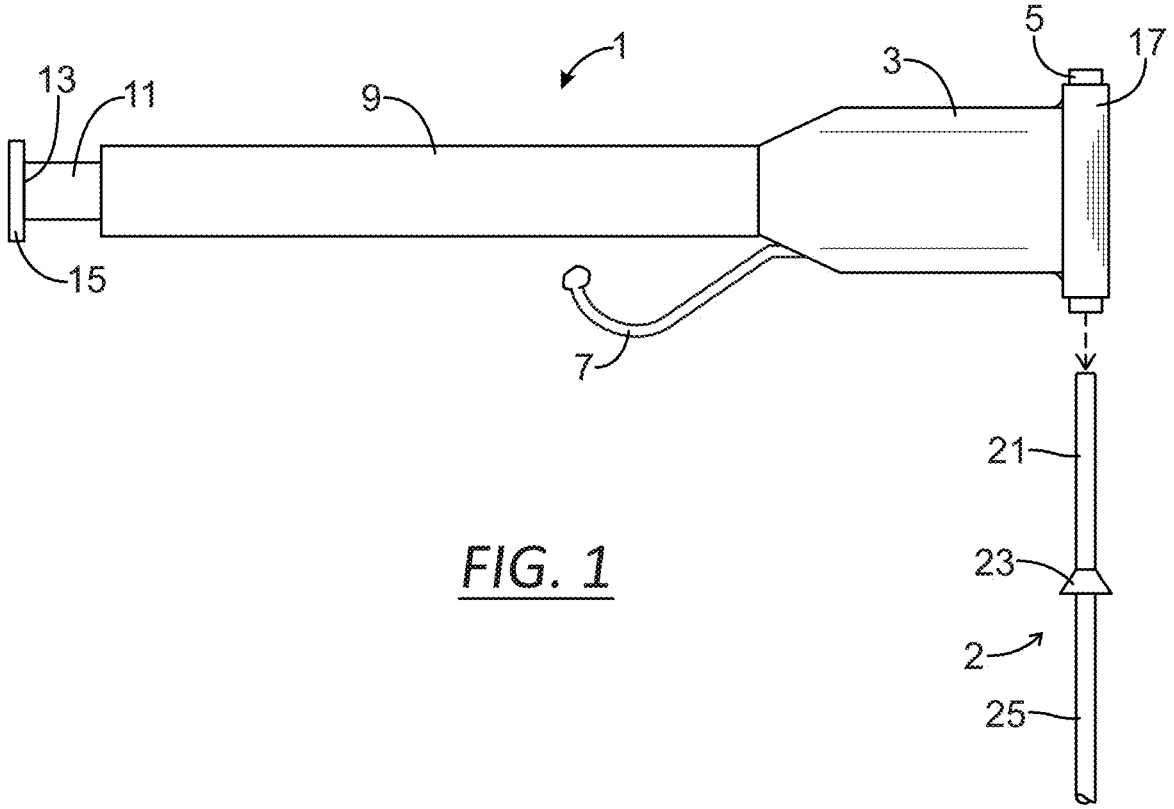
FIG. 1 is a side view of an embodiment of a door hinge attachable telescopic hanger and pin system according to the present invention, illustrating the present invention hanger and door hinge pin apart.

It should be noted that the present invention devices are for hanging and for transporting any item on hangers, such as clothes. The present invention devices may be used for hanging wet clothes for drying, clothes that need ironing, clothes that are put out for wearing, and for cloth items, e.g. clothes, towels and washcloths that merely need temporary or closet-alternative storing with mobility options. The present invention devices are hangable on ropes, wires, rods or pins. The present invention devices not only attach to the pin receivers of door hinges, but they are also removable from the pin or with the pin, and may be hooked on or attached to any other supports or suspensions. Thus, they may be moved from location to location with the clothes on conventional, individual coat hangers. The hinge pin is included that has an upper section that permits one-step sliding of the device onto it and off it. This permits easy installation and portability. For example, the device is easily moved from a laundry room to a TV room where ironing may be done, and then to a closet.

Referring now to the drawings, wherein like reference numerals indicate identical corresponding parts throughout the Figures.

FIG. 1 is a side view of an embodiment of a door hinge attachable telescopic hanger 1 and pin 2, operating together as a system. In this FIG. 1, hanger 1 and pin 2 are shown separately. Also, pin 2 has a truncated lower section 25, it being understood that its length is sufficient to enter the hinge female receiver components of a hinge set. A hinge set is a door jamb-mounted hinge and a door-mounted hinge connected with a hinge pin. The hinge receiver components are the sectional vertical tube portions of hinges that intermesh and receive the connecting hinge pin. In the present invention, the conventional hinge pin is replaced by the present invention pin 2. In this FIG. 1 side view that includes hanger 1 and pin 2 according to the present invention, hanger 1 includes an elongated main support member 9 that is connected to pin vertical shaft attachment member 5 and extending outwardly therefrom at a non-parallel angle to and away from the vertical shaft attachment member 5. Typically, the elongated main support member 9 is a formed metal or plastic piece that may be unistructurally formed with attachment member 5, or attachment member 5 may be formed separately and then welded, heat welded, or otherwise attached to one another. A handle-sheath 3 with vertical shaft attachment member cover 17 is included to create an ergonomic handle for locating and relocating the present invention hanger 1. This a handle-sheath 3 that usually covers at least half the door hinge attachment member and a portion of the elongated main support member 9, as shown. There is an optional coat hook 7. Elongated main support member 9 is hollow and contains at least one additional (supplemental) moveable support member 11, telescopically connected to elongated main support member 9. In this embodiment, support member 11 is also hollow and contains a second support member 13 with a stop flange 15 at the end to prevent coat hangers on it from sliding off. These elongated components may have any cross-sectional end view shape, including circular, square, oblong, oval or other polygonal shape, as well as irregular and asymmetric shapes, without exceeding the scope of the present invention.

Also shown in FIG. 1 is modified, elongated hinge pin 2. This is modified relative to a conventional door hinge pin and has an upper section 21, a lower section 25 and a dividing stop flange 23 therebetween. This pin 2 replaces a conventional hinge pin on a door hinge. Lower section 25 replaces the conventional hinge pin and when it is inserted into a hinge set, it cannot be pushed in further due to stop flange 23, leaving upper section 21 open to receive the present invention telescopic hanger 1. The upper and lower sections may be the same or different thicknesses and the same or different in cross-sectional shape, although the lower section is usually circular in shape to fit conventional door hinge receivers, and the upper section should be of adequate shape to have the vertical shaft attachment member 5 of hanger 1 securely fit on it. It is important that the dividing stop flange of the modified pins have at least apportion that is wider than the width of the lower member and wider than the hinge receivers, so that it functions as a stop.

Figure 3:
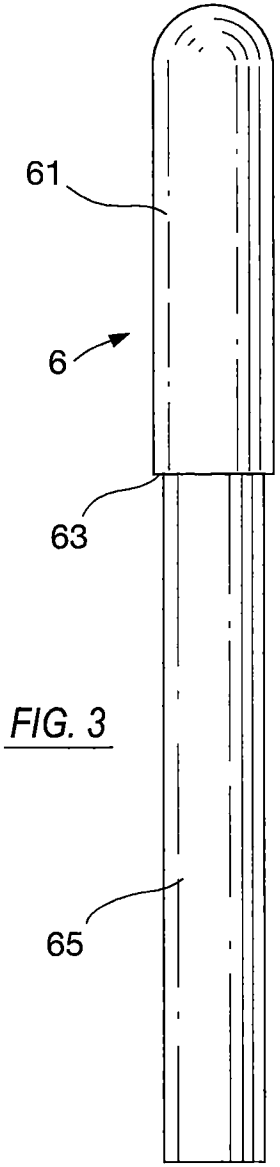
FIGS. 2 and 3 are side views of present invention alternative pins.
Figure 2:
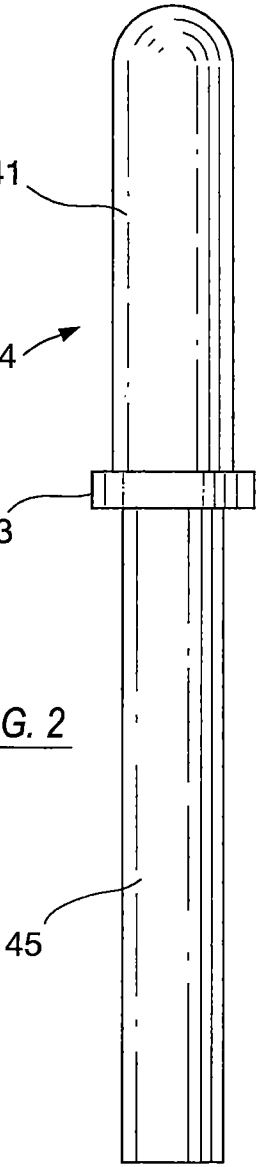

FIGS. 2 and 3 are side views of present invention alternative pins 4 and 6. In FIG. 2, present invention pin 4 has a wide upper section 41, a narrower lower section 45 and a stop flange 43 therebetween. Note that lower section 45 is the narrowest, upper section 41 is wider than lower section 45, but narrower than flange 43. Hence, flange 43 is widest. In FIG. 3, the pin 6 has a stop flange that is solely the wider bottom 63 of upper section 61, which is of sufficient width to permit only lower section 65 to enter conventional hinge receivers.

Figure 4:
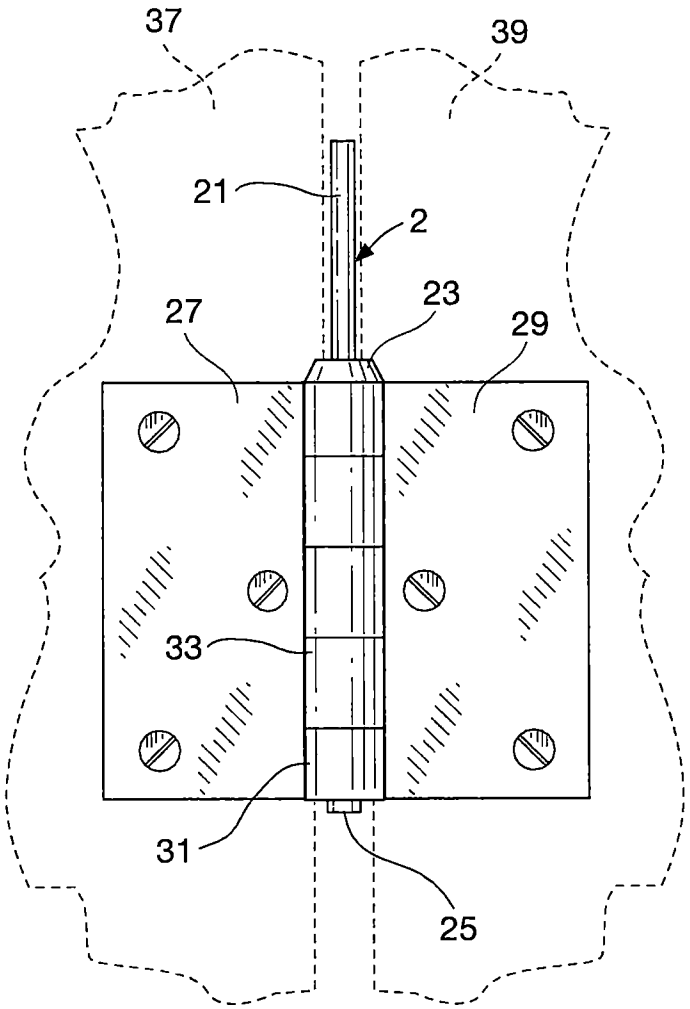
FIG. 4 is a side view of the present invention pin of FIG. 1, now inserted into hinge receivers of door and doorjamb hinges in place of a conventional hinge pin.

FIG. 4 is a side view of the present invention pin 2 of FIG. 1, partially deployed. That is, it is now inserted into hinge receivers of the hinges 27 and 29 of door 37 and doorjamb 39 respectively. Thus hinges 27 and 29 have intermeshed receivers such as receivers 31 and 33, which are kept in place by lower section 25 of present invention pin 2. In this FIG. 4, upper section is open to receive a present invention telescopic handle 1.

Figure 5:
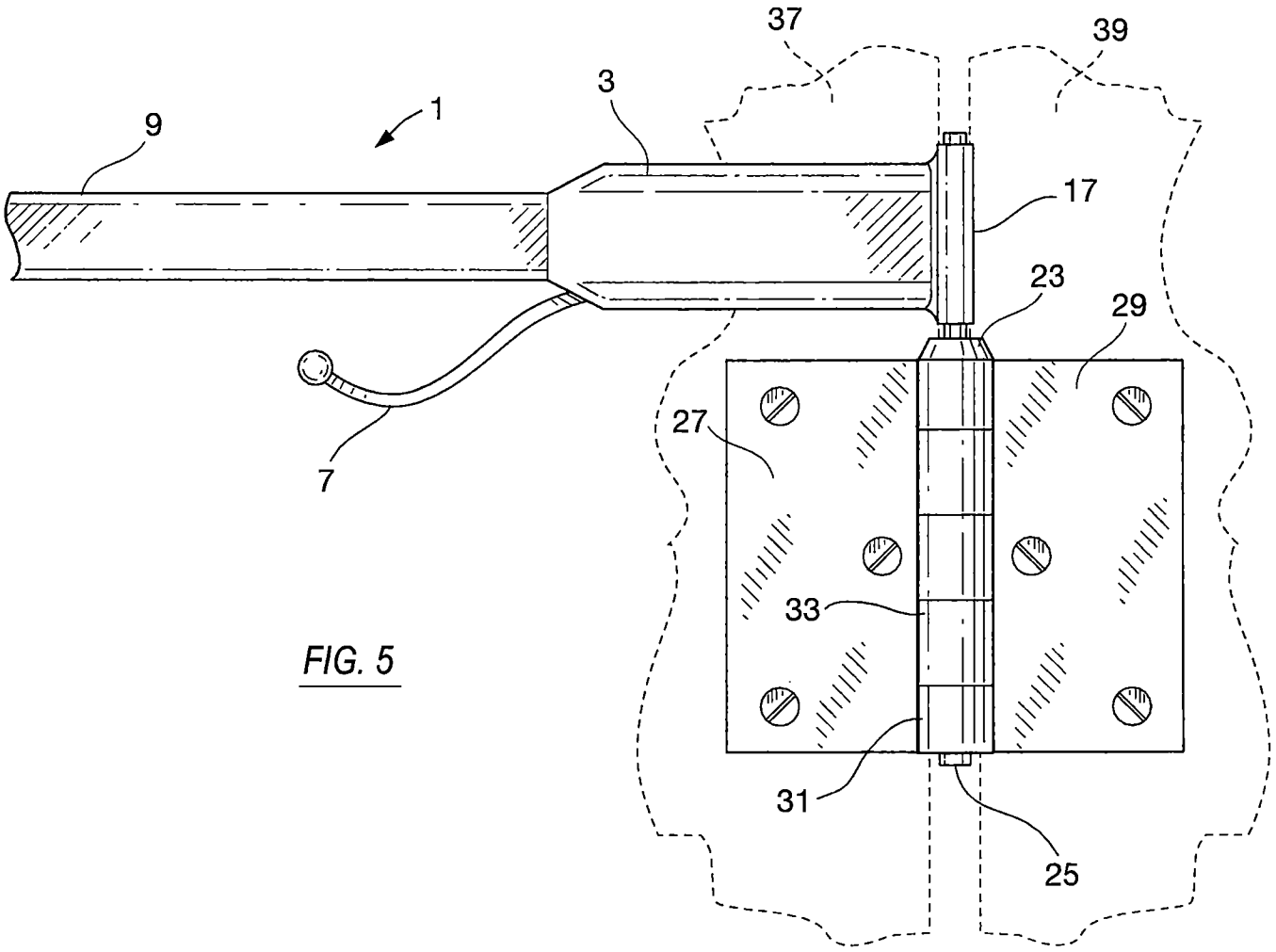
FIG. 5 is a side view of the present invention pin and hinges as shown in FIG. 4, but now with the present invention telescopic hanger of FIG. 1 attached to its pin.

FIG. 5 is a side view of the present invention pin 2 and hinges 27 and 29 as shown in FIG. 4, but now with the present invention telescopic hanger 1 of FIG. 1 attached to its pin 2. Other aspects thereof are identically numbered as set forth above.

Figure 6:
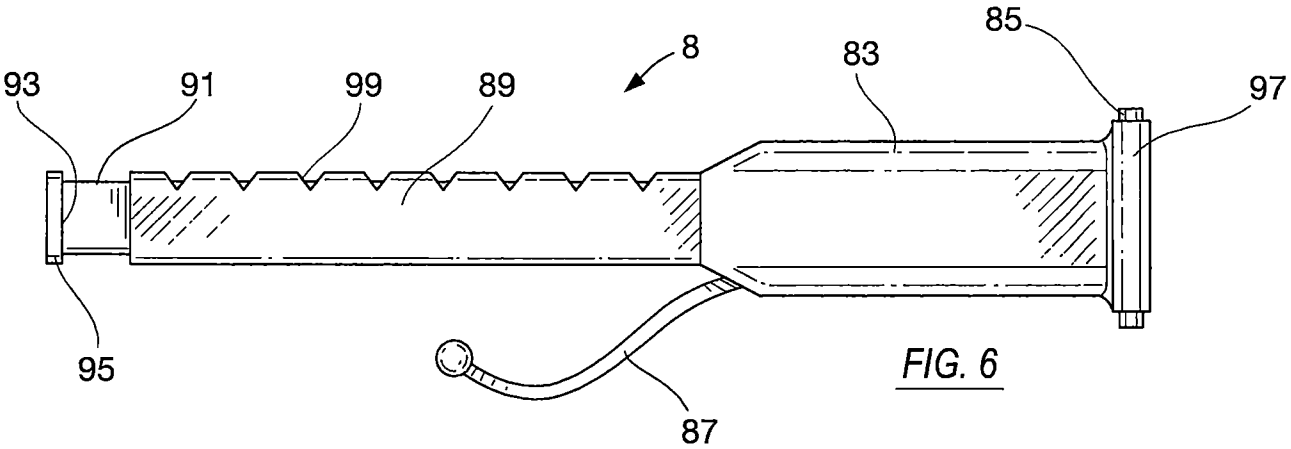
FIGS. 6 and 7 illustrate alternative embodiment present invention door hinge attachable telescopic hanger and pin systems.
Figure 7:
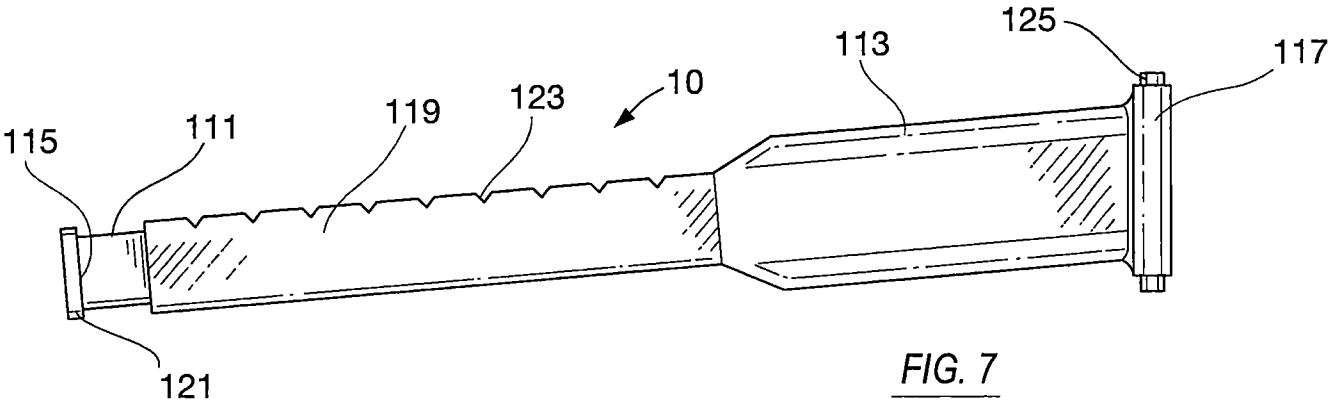

FIGS. 6 and 7 illustrate alternative embodiment present invention door hinge attachable telescopic hangers 8 and 10.

In FIG. 6, hanger 8 includes an elongated main support member 89 that is connected to pin vertical shaft attachment member 85 and extending outwardly therefrom at a non-parallel angle to and away from the vertical shaft attachment member 85. (The expression "non-parallel angle to . . . the vertical shaft attachment member" means that it could be slightly or significantly tilted upward or downward or be at right angles to the vertical shaft attachment member.) In this embodiment, the elongated main support member 89 is at a right angle to the vertical shaft attachment member 85 and they are both formed metal, and the attachment member 85 has been formed separately and then welded to main support member 89. Due to the fact that plastic handle 83 with cover 97 covers the weld areas, these welds may be rough soldered and burrs or imperfections are safely hidden from view and touch. Thus, handle-sheath 83 with vertical shaft attachment member cover 97 is included to also create an ergonomic handle for locating and relocating the present invention hanger 8. There is an optional coat hook 87. Elongated main support member 89 is hollow and contains at least one additional (supplemental) moveable support member 91, telescopically connected to elongated main support member 89. In this embodiment, supplemental support member 91 is also hollow and contains a second support member 93 with a stop flange 95 at the end to prevent coat hangers on it from sliding off. Also in this embodiment, the elongated main support member 89 has a plurality of spaced notches, such as notch 99 to catch and hold individual coat hangers that may be suspended therefrom.

In FIG. 7, present invention telescopic hanger 10 includes an elongated main support member 119 that is connected to pin vertical shaft attachment member 125 and extending outwardly therefrom at a non-parallel angle, in this case tilted outwardly and downwardly, away from the vertical shaft attachment member 125. In this embodiment, the elongated main support member 119 is a formed of plastic, and the attachment member 125 has been unistructurally formed, i.e., in a single compound mold, with main support member 19. Due to the fact that handle 113 with cover 117 covers the mold intersection areas, flaws and mold port burrs or imperfections are safely hidden from view and touch. Thus, handle-sheath 1133 with vertical shaft attachment member cover 117 is included to also create an ergonomic handle for locating and relocating the present invention hanger 10. Elongated main support member 119 is hollow and contains at least one additional (supplemental) moveable support member 111, telescopically connected to elongated main support member 119. In this embodiment, supplemental support member 111 is also hollow and contains a second support member 115 with a stop flange 121 at the end to prevent coat hangers on it from sliding off. Also in this embodiment, the elongated main support member 119, and other telescoping support members, have a plurality of spaced notches, such as notch 123 to catch and hold individual coat hangers that may be suspended therefrom.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A door hinge-attachable telescopic hanger with a pin, which comprises:

i) said door hinge-attachable telescopic hanger comprising:

a) a door hinge attachment member, including an open-ended vertical shaft for attachment to a door hinge and said pin;

b) an elongated main support member directly connected to said door hinge attachment member and extending outwardly therefrom at a non-parallel angle to said vertical shaft, said elongated main support member extending away from said door hinge attachment member;

c) at least one moveable supplemental support member telescopically connected to said elongated main support member for movement extending away from said door hinge attachment member;

d) a handle-sheath coupled to said door hinge attachment member and said elongated main support member and configured to cover and surround at least half of said door hinge attachment member and a portion of said elongated main support member where directly connected to said door hinge attachment member; and, ii) said pin having a pin upper section and a pin lower section, and having a stopping flange between said pin upper section and said pin lower section, wherein said pin lower section is adapted to replace a door hinge pin and said upper section is adapted to receive said door hinge attachment member by inserting said pin upper section into said vertical shaft of said door hinge attachment member.

2. The door hinge attachable telescopic hanger of claim 1 wherein said vertical shaft of said door hinge attachment member is a cylindrical shaft and is adapted to be positioned above a door hinge and on said upper portion of said pin.

3. The door hinge attachable telescopic hanger of claim 1 wherein said elongated main support member is hollow and said at least one moveable supplemental support member is positioned therein for telescopic movement in and out of said elongated main support member.

4. The door hinge attachable telescopic hanger of claim 3 wherein at least one of elongated said main support member and said at least one moveable supplemental support member includes a stop flange that prevents separation during telescoping.

5. The door hinge attachable telescopic hanger of claim 1 further comprising at least one clothes hook.

6. The door hinge attachable telescopic hanger of claim 1 wherein said elongated main support member is positioned at a right angle to said vertical shaft of said door hinge attachment member.

7. The door hinge attachable telescopic hanger of claim 1 wherein said elongated support member is positioned at a top angle of less than 90 degrees.

8. The door hinge attachable telescopic hanger of claim 1 wherein there are two of said at least one moveable supplemental support members, where said two moveable supplemental support members are telescopically connected to one another.

9. The door hinge attachable telescopic hanger of claim 8 wherein said vertical shaft of said door hinge attachment member is a cylindrical shaft and is adapted to be positioned above a door hinge and on said upper portion of said pin.

10. The door hinge attachable telescopic hanger of claim 8 wherein said elongated main support member is hollow and said at least one moveable supplemental support member is positioned therein for telescopic movement in and out of said elongated main support member.

11. The door hinge attachable telescopic hanger of claim 10 wherein at least one of elongated said main support member and said at least one moveable supplemental support member includes a stop flange that prevents separation during telescoping.

12. The door hinge attachable telescopic hanger of claim 8 further comprising at least one clothes hook.

13. The door hinge attachable telescopic hanger of claim 8 wherein said elongated main support member is positioned at a right angle to said open-ended vertical shaft of said door hinge attachment member.

14. The door hinge attachable telescopic hanger of claim 8 wherein said pin has an elongated shaft with at least three different thicknesses, and said stop flange has a greater thickness than said upper section and said lower section, and said upper section has a thickness that is greater than said lower section.

* * * * *